United States Patent [19]

Fukamichi

[11] Patent Number: 5,060,478

[45] Date of Patent: Oct. 29, 1991

[54] MAGNETICAL WORKING AMORPHOUS SUBSTANCE

[75] Inventor: Kazuaki Fukamichi, Sendai, Japan

[73] Assignee: Research Development Corporation of Japan, Tokyo, Japan

[21] Appl. No.: 401,545

[22] Filed: Aug. 31, 1989

Related U.S. Application Data

[63] Continuation of Ser. No. 156,851, Feb. 17, 1988, abandoned, which is a continuation of Ser. No. 848,377, Mar. 12, 1986, abandoned.

[30] Foreign Application Priority Data

Jul. 27, 1984 [JP] Japan ..... 1-155562
Feb. 8, 1985 [JP] Japan ..... 2-21915

[51] Int. Cl.[5] ..... F25B 21/00

[52] U.S. Cl. ..... 62/3.1; 148/403; 148/304

[58] Field of Search ..... 62/3.1; 148/403, 304

[56] References Cited

U.S. PATENT DOCUMENTS

| | | | |
|---|---|---|---|
| 3,427,154 | 2/1969 | Mader et al. | 148/304 |
| 3,856,513 | 12/1974 | Chen et al. . | |
| 4,116,682 | 9/1978 | Polk et al. . | |
| 4,306,908 | 12/1981 | Takayama et al. | 148/304 |
| 4,409,043 | 10/1983 | Koon | 148/403 |
| 4,437,912 | 3/1984 | Sakakima et al. | 148/304 |
| 4,504,327 | 3/1985 | Inomata et al. | 148/304 |
| 4,564,399 | 1/1986 | Tateishi et al. | 148/304 |
| 4,578,728 | 3/1986 | Sakakima et al. | 148/304 |
| 4,623,387 | 11/1986 | Masumoto et al. | 420/83 |

FOREIGN PATENT DOCUMENTS

| | | | |
|---|---|---|---|
| 56-116854 | 9/1981 | Japan | 148/403 |
| 57-19538 | 2/1982 | Japan | 148/403 |
| 57-54250 | 3/1982 | Japan | 148/403 |
| 58-165306 | 9/1983 | Japan | 148/304 |
| 59-67612 | 4/1984 | Japan | 148/304 |
| 59-108304 | 6/1984 | Japan | 148/304 |
| 60-246042 | 12/1985 | Japan | 148/304 |
| 61-15308 | 1/1986 | Japan | 148/304 |
| 2113371A | 8/1988 | United Kingdom . | |
| WO80/02159 | 10/1980 | World Int. Prop. O. | 148/403 |
| WO81/00861 | 4/1981 | World Int. Prop. O. . | |

OTHER PUBLICATIONS

Journal of Applied Physics, vol. 55, No. 6, Part IIA, Mar. 1984, pp. 1800–1804, American Institute of Physics, New York, U.S.; J. M. D. Coey et al.: "Influence of Hydrogen on the Magnetic Properties of Iron-Rich Metallic Glasses".

Cryogenics, vol. 22, No. 2, Feb. 1982, pp. 73–80, Butterworth & Co. (Publishers) Ltd.; J. A. Barclay et al., "Materials for Magnetic Refrigeration Between 2 K and 20 K".

*Primary Examiner*—Albert J. Makay
*Assistant Examiner*—John Sollecito
*Attorney, Agent, or Firm*—Armstrong, Nikaido, Marmelstein, Kubovcik & Murray

[57] ABSTRACT

As magnetically working substances capable of producing magnetically working abilities such as magnetic refrigeration or cooling in a wide range of temperatures with high efficiency, this invention utilizes amorphous alloys possessing a large magnetic moment and the spin glass property. Concrete examples of the amorphous alloys which meet the requirement are amorphous alloys containing rare earth metals, the same amorphous alloys absorbed hydrogen therein, and Fe-based amorphous alloys containing additional elements for formation of the amorphous phase. One element or the combination of two or more elements selected from the group just mentioned can be used, with the composition of alloys so adjusted for the desired magnetic transition points to be distributed or for the different magnetic transition points to be continuously distributed in a range of high to low temperatures. The magnetically working substances so produced are enabled to create magnetically working abilities by exposing to an external weak or strong magnetic field and subsequently adiabatical demagnetizing. It finds utilities in applications to very big plants such as MHD power generation, nuclear fusion, and energy storage and to various devices such as linear motors, electronic computers and their peripheral appliances.

13 Claims, 19 Drawing Sheets

$Gd_{55}Al_{45}$
1000 Oe
500 Oe
150 Oe
100 Oe
30 Oe
160
140
120
100
80
60
40
20
0
σ (emu/g)
0
50
100
150
T(K)

$Gd_{65}Al_{35}$
1000 Oe
500 Oe
150 Oe
100 Oe
30 Oe
σ (emu/g)
160
140
120
100
80
60
40
20
0
0
50
100
150
T(K)

MAGNETICAL WORKING AMORPHOUS SUBSTANCE

This application is a continuation of application Ser. No. 156,851 filed Feb. 17, 1988 now abandoned, which is a continuation of Ser. No. 848,377, filed Mar. 12, 1986, now abandoned.

FIELD OF THE INVENTION

This invention relates to a magnetically working substance of amorphous alloys. More particularly, this invention relates to a magnetically working amorphous substance possessed of excellent magnetically working abilities (such as a magnetic refrigeration or cooling) by the combination of the spin glass property and the magnitude of magnetic moment in the amorphous alloys.

BACKGROUND OF THE INVENTION

Heretofore, as magnetically working substances, such oxides and compounds containing oxygen as $Dy_2Ti_2O_7$, $DyPO_4$, $Gd(OH)_3$, and $Gd_2(SO_4).8H_2O$ have been treated as magnetic refrigeration materials and expected to find utility in cryogenic refrigeration near the liquefaction temperature of helium.

These compounds entail various restrictions and disadvantages: (1) They are deficient in magnetic refrigeration efficiency because their contents of magnetic elements (Dy, Gd, etc.) per molecular unit are small. (2) They are incapable of attaining desired refrigeration from a high temperature such as room temperature because their Curie point or Néel point is as low as about 10 T (K) at most. (3) Since these compounds possess the Curie point or the Néel point and, therefore, permit a simple refrigeration to be carried out rather efficiently only at and around such points, they cannot be expected to work effectively outside but narrow temperature ranges centering around such points. (4) Since they are compounds possessing low degrees of the thermal conductivity, they are deficient in refrigeration efficiency and its output. (5) Since they require a strong magnetic field ranging from several teslas to 10 teslas in generating their magnetical working, they are enabled to have magnetically working abilities by using only superconducting magnets which have come to be feasibilized recently.

This invention aims to eliminate the aforementioned restrictions and disadvantages related to the conventional magnetically working substances and provide novel and original magnetically working substances which, by virtue of adiabatic demagnetization, manifest magnetically working abilities with an extremely high efficiency in a wide temperature range under strong magnetic fields as well as under weak magnetic fields using superconducting magnets or even under weak magnetic fields using conventional electromagnets and, therefore, finds utility in applications to big plants for MHD power generation, nuclear fusion, and energy storage and to other various devices such as linear motors, electronic computers and their peripheral devices.

DISCLOSURE OF THE INVENTION

As the first step toward the attainment of the objects described above, the inventor has analyzed and studied from various angles the causes for the disadvantages inherent in the conventional magnetically working substances formed of oxides, etc.

It has been ascertained by the inventor that there practically persists an inevitable fixing of the working temperature at an extremely low level near the liquefaction temperature of helium suiting the purpose of magnetically working abilities such as cryogenic refrigeration. Consequently the oxides or compounds containing oxygen possessing such a magnetic transition temperature as the Curie point of the Néel point in the zone of the aforementioned extremely low level should be used. Because of these restrictions, the magnetic transition of these compounds is utilized under severe conditions and the characteristic properties of the compounds as magnetically working substances, therefore, are prevented from being efficiently utilized and materialized.

In such circumstances, the inventor has conceived the idea of critical reviewing, in an entirely different light, the utilization of the characteristic properties of magnetically working substances and has continued a diligent study directed to elucidating the fundamental principles of magnetically working abilities.

He has consequently come to note the fact that the magnetically working abilities depend, as illustrated in FIG. 1, on the relation between the change of the magnetic entropy $\Delta Sm$ caused by the external magnetic field and the temperature dependence thereof and this value of $\Delta Sm$ exhibits its maximum value near the magnetic transition point such as the Curie point or the Néel point and has found that distribution of the magnetic transition points in a wide range and consequently the distribution of temperatures of magnetically working abilities in a wide range can be materialized by using the amorphous alloys. It has been further ascertained by the inventor that the desired distribution of temperatures of magnetically working abilities in a wide range and the desired magnitude of the value of $\Delta Sm$ can both be fulfilled by making the most of the knowledge that the value of $\Delta Sm$ is governed by the magnetic moment in the substance and enhanced by the utilization of the amorphous alloys containing rare earth metals.

The amorphous alloys containing rare earth metals have been found to possess a peculiar temperature dependence of magnetization in accordance with the intensity of the applied external magnetic field, exhibit an unstable state (A) in which, even in a weak magnetic field, the spins in atoms are aligned as easily as in a strong magnetic field as shown in FIG. 2, and manifest the spin glass property (B) having the spins in atoms oriented randomly in a demagnetized state or in a very weak magnetic field as though the amorphous alloys were paramagnetic. It has been found, consequently, that owing to the utilization of these properties, the magnetical working of the amorphous alloys containing rare earth metals can be efficiently manifested even by application of a weak magnetic field as well as a strong magnetic field, unlike the conventional magnetically working substances require a strong magnetic field.

The inventor, with the belief that the fundamental principles in the aforementioned magnetical working elucidated as described above have the possibility of being applied widely to other amorphous alloys having a large magnetic moment, has continued a diligent study on various amorphous alloys.

The aforementioned magnetically working amorphous substances containing rare earth metals, for example, have originated in the interest attracted to the large magnetic moment in rare earth metals and have culminated in utilization of amorphous alloys containing such rare earth metals. In a similar way, other amorphous alloys possessing a large magnetic moment can be utilized to advantage. For example, Fe-based, Co-based and Ni-based amorphous alloys answer this demand.

Only because given amorphous alloys possess a large magnetic moment, it does not necessarily follow, without the spin glass property required to possess to be advantageously utilized as magnetically working substances, that these particular amorphous alloys become suitable materials. In the 3d transition metal elements (Fe, Co and Ni), therefore, the inventor has focused his attention upon Fe from the standpoint of the spin glass property and has concentrated his study on Fe-based amorphous alloys.

To be specific, Fe-based alloys are substances whose state is transformed between a stable bcc (body-centered cube) with a strong ferromagnetism and an unstable fcc (face-centered cube) with a weak ferromagnetism by controlling the temperature and the composition. In contrast, the Fe-based amorphous alloys which have heretofore been manufactured as magnetic alloys contain additional elements (for formation of the amorphous phase) in a relatively large amount and assumed as a stable state possessing a strong ferromagnetism at room temperature. Conversely, Fe-based alloys containing the dilute additional element have been particularly disregarded because an unstable state with a weak ferromagnetism at room temperature. This fact implies that when the Fe-based alloys are made in the amorphous phase by addition of a relatively small amount of the additional element to Fe, their magnetic properties become very similar to those of the magnetically unstable fcc iron (Fe). It has been established that this unstable state constitutes itself the cause of the spin glass property.

In fact, it has been demonstrated that, compared with the common amorphous alloy $Fe_{70}Hf_{30}$, the amorphous alloy $Fe_{92.5}Hf_{7.5}$ containing a dilute Hf content possesses a peculiar temperature dependence of magnetization in accordance with the intensity of the external magnetic field as illustrated in FIG. 20.

The inventor has continued a further study with a view to enhancing the operational efficiency of the aforementioned magnetically working amorphous substances containing rare earth metals and Fe-based magnetically working amorphous substances. He has consequently found magnetically working amorphous substances containing rare earth metals possessing a large magnetic moment and absorbing large amounts of hydrogen and exhibiting a notably high Debye temperatures. What should be noted at this point is the fact that the Debye temperature bears closely on the efficiency of magnetically working.

The loss of the efficiency of magnetic refrigeration is mainly caused by the lattice load. As illustrated in FIG. 3, the lattice entropy $S_L$ dwindles as the load for magnetic refrigeration decreases and the efficiency of refrigeration increases in proportion as the Debye temperature $\theta_D$ rises. It has been further ascertained by the inventor that when magnetically working amorphous substances containing rare earth metals possess a large magnetic moment and the Debye temperature is increased by absorption of hydrogen, the efficiency of magnetic refrigeration of the substance is further enhanced.

The present invention has been perfected on the basis of the various discoveries made during the course of studies mentioned above. It may be outlined as follows:

(1) Magnetically working amorphous substances containing rare earth metals possessing a large magnetic moment and the spin glass property, the same amorphous alloys absorbed hydrogen therein or Fe-bases amorphous alloys containing additional elements for formation of the amorphous phase, with the compositions of the aforementioned alloys so adjusted as to provide the substances with the desired magnetic transition points distributed throughout high to low temperatures and, by adiabatic demagnetization in a strong magnetic field or weak magnetic field, permit excellent magnetically working abilities to be displayed in a wide range of working temperatures.

(2) Magnetically working amorphous substances formed one member or the combination of at least two same or different elements selected from the group consisting of the aforementioned amorphous alloys containing the rare earth metals, the same amorphous alloys absorbed hydrogen therein, and the Fe-based amorphous alloys, with the compositions of the alloys of combined alloys so adjusted as to provide the substances with the various magnetic transition points distributed continuously throughout high to low temperatures and, by adiabatic demagnetization in a strong magnetic field or a weak magnetic field, permit excellent magnetically working abilities to be displayed in a wide range of working temperatures.

PREFERRED EMBODIMENT OF THE INVENTION

Now, the principles of magnetically working abilities underlying the present invention will be described more specifically below.

Figure 1B:
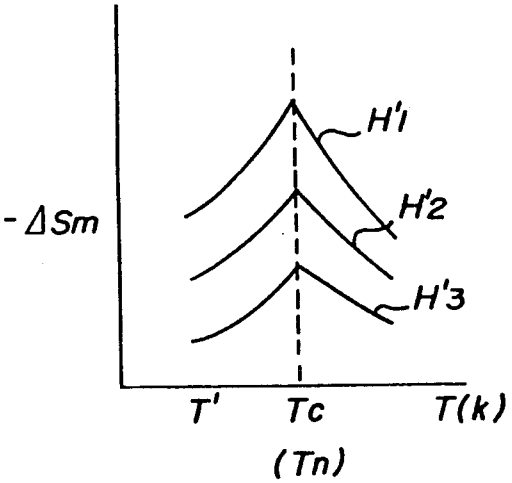
FIGS. 1 (A) and (B) show the schematic diagrams illustrating the temperature dependence of the change of the magnetic entropy $\Delta Sm$ in accordance with the external magnetic field; (A) representing the case of this invention and (B) the conventional case.
Figure 2B:
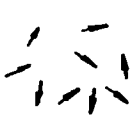
FIG. 2 shows the schematic diagram illustrating the temperature dependence of magnetization; (A) and (B) representing conditions of different spin arrangements.
Figure 2A:
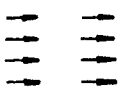
Figure 1A:
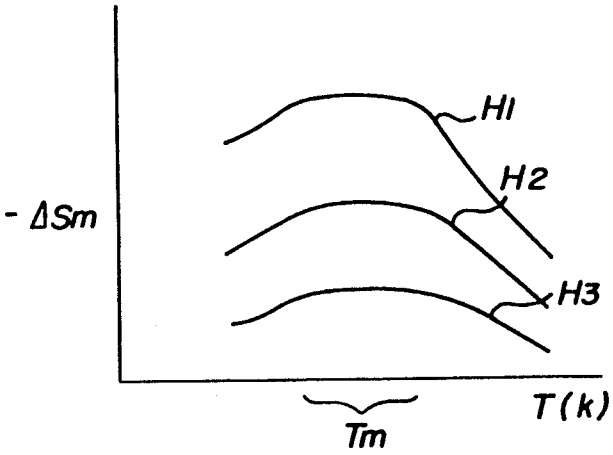

FIG. 1 shows the temperature dependence of the change of the magnetic entropy ΔSm caused by the external magnetic field H; the part (A) of the figure representing the data of the amorphous alloy according to this invention and the part (B) the data of the conventional oxide.

The conventional oxide, as shown in FIG. 1 (B), cannot be expected to provide efficient magnetic refrigeration except at one sharp temperature, i.e. the Curie point $T_c$ or the Néel point $T_N$ (generally being located in the neighborhood of the liquefaction temperature of helium). In contrast, the amorphous alloys of the present invention are capable of manifesting efficient magnetically working abilities in a wide range in which the magnetic transition points Tm are distributed. The value of ΔSm can be expressed, for example, by the following formula.

$$\Delta Sm = R \log (2J+1) \quad (1)$$

where R stands for the constant and J the angular momentum in atoms.

With reference to FIG. 1 (A), since the amorphous alloys are spin glasses, the spins of atoms are easily aligned even in a relatively weak magnetic field when the magnetic transition point becomes below Tm and, as the result, the value of ΔSm becomes larger than that in any other temperature ranges.

In this respect, the conventional oxides have their working temperature fixed at a level T' lower than either the Curie point $T_c$ or the Néel point $T_N$ as shown in FIG. 1 (B). Even below $T_c$ or $T_N$, the spins are not in a perfectly parallel state because of thermal agitation and any attempt to align parallel the spins fails with a magnetic field which uses an ordinary electromagnet. This purpose necessitates a strong external magnetic field using a superconducting magnet of a magnetic flux density of several teslas to ten teslas, for example. Since the value of ΔSm which is obtained is aimed at producing an operation near the liquefaction temperature of helium and, hence, the operation is carried out at a level considerably lower than $T_c$ or $T_N$, then the value of ΔSm is inevitably small.

The present invention utilizes the amorphous alloys for the purpose of enabling the working temperature possessing a large value of ΔSm to be distributed in a wide range. It contemplates producing magnetically working substances formed of amorphous alloys containing rare earth metals based on the knowledge that the magnitude of the value of ΔSm, as described above, is directly proportional to the magnitude of the magnetic moment M ($\mu_B$) in the rare earth metal components. It further contemplates producing magnetically working substances formed of Fe-based amorphous alloys containing additives for formation of the amorphous phase based on the knowledge that the magnitude of the value ΔSm is directly proportional to the magnitude of the magnetic moment M ($\mu_B$).

Further, this invention can produce magnetically working substances formed of the amorphous alloys containing rare earth metals absorbed hydrogen therein.

Now, the operating principles of the magnetically working substances will be described below.

The relation between the magnetic refrigeration and the lattice load responsible for the loss of efficiency thereof is as follows.

First, the total entropy of a magnetic substance is given by the following formula (2).

$$S_T = Sm + S_L \quad (2)$$

During the course of magnetic refrigeration, it is the magnetic entropy Sm alone that is changed by the magnetic field. The lattice entropy $S_L$ is not changed by the magnetic field. Since it is the magnetic entropy Sm that possesses a refrigeration function, therefore, the magnetic system is required to make cool the lattice system. This cooling load is called the "lattice load." In other words, the cooling efficiency decreases as the lattice load increases.

The lattice entropy $S_L$ involved in the aforementioned formula (2) is given by the following formula (3).

$$S_L = \int_0^T \frac{C_L}{T} dT \quad (3)$$

In this formula, $C_L$ is expressed by the following formula.

$$C_L = 9 N k_B \left(\frac{T}{\theta_D}\right) \int_0^x \frac{x^4 e^x}{(e^x - 1)^2} dx$$

where N stands for the atomic number, $k_B$ the Boltzmann constant, $\theta_D$ the Debye temperature and x is the Debye function given by $x = \theta_D/T$.

At low temperatures, the lattice entropy $C_L$ is given by the following formula (4).

$$C_L \approx \beta T^3 = 234 N k_B \left(\frac{T}{\theta_D}\right)^3 \quad (4)$$

Figure 3:
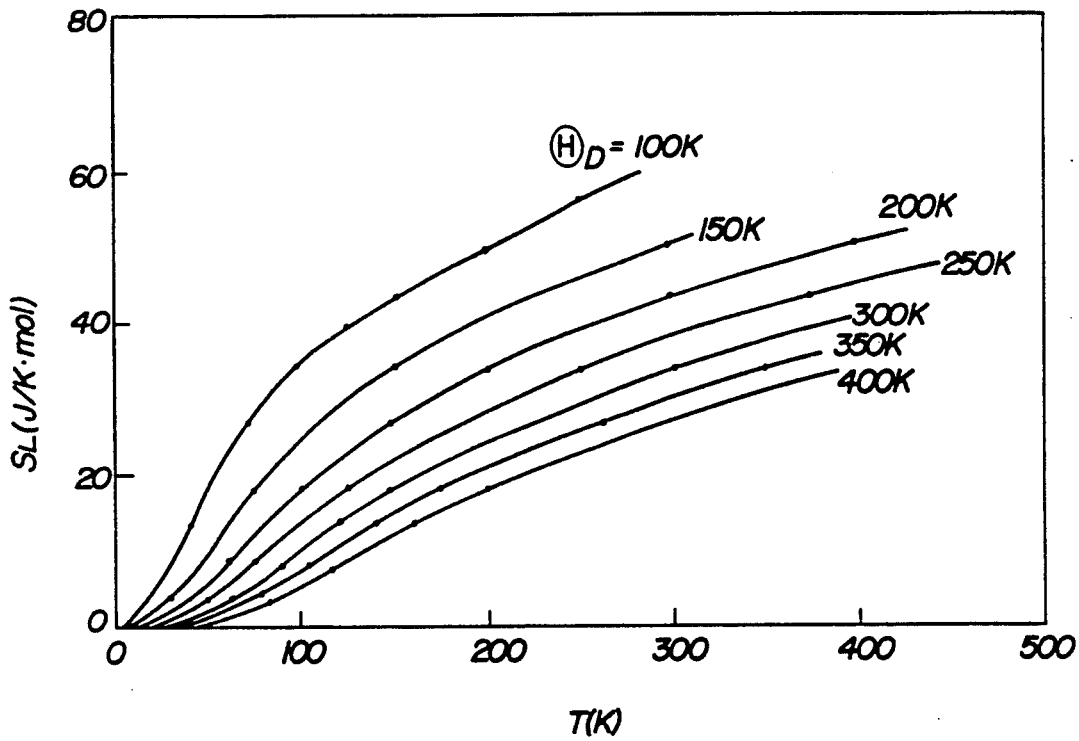
FIG. 3 shows the temperature dependence of the lattice load $S_L$ as a function of the Debye temperature $\theta_D$.

It is noted from the foregoing formulas (3) and (4) that the lattice load decreases in proportion as the Debye temperature $\theta_D$ rises. The relations described above will be described specifically below with reference to FIG. 3. FIG. 3 shows the relation between the temperature dependence of the lattice entropy $S_L$ as a function of the Debye temperature $\theta_D$. In this figure, the ordinate is the scale of $S_L$ which signifies that the lattice load increases and the refrigeration efficiency decreases with increasing the magnitude of the lattice entropy. Where the Debye temperatures are 100 K. and 400 K. and the working temperature (abscissa) is 100 K., for example, the lattice entropy $S_L$ for $\theta_D = 100$ K. is about 34 J/K.mol and that for $\theta_D = 400$ K. is about 7 J/K.mol, being about one fifth of the former value.

Figure 4:
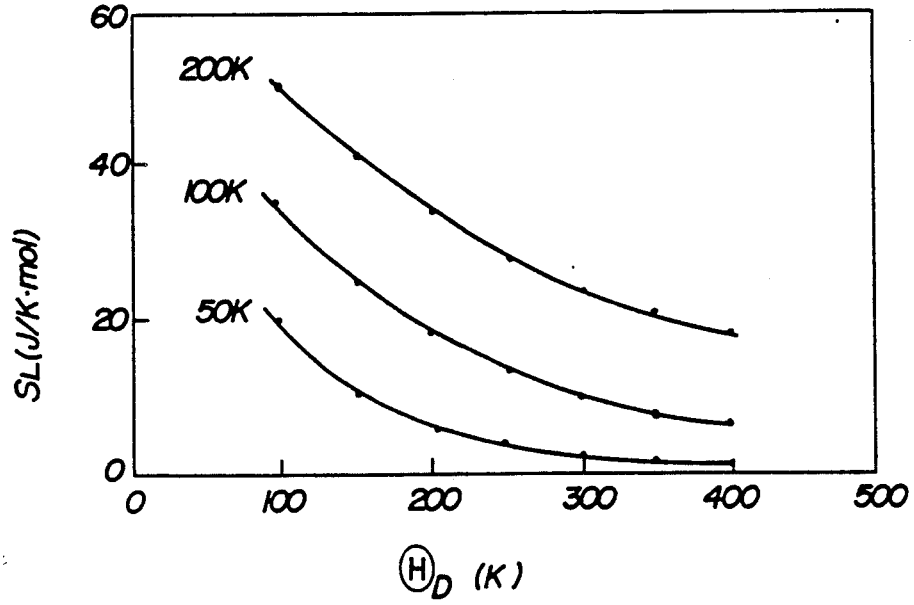
FIG. 4 shows the relation between the lattice load $S_L$ and the temperature as a function of the Debye temperature $\theta_D$.
Figure 5:
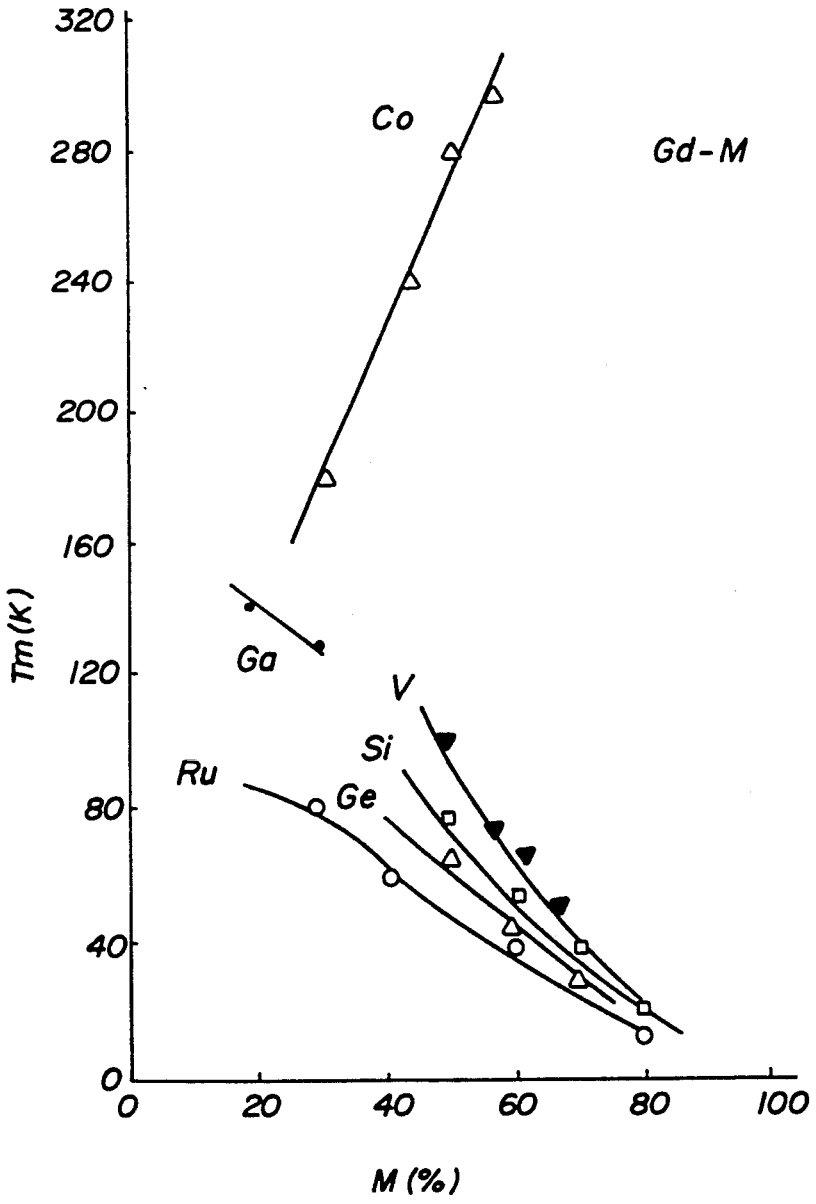
FIGS. 5 through 11 show the composition dependence of the magnetic transition point Tm of various amorphous alloys containing rare earth metals.
Figure 6:
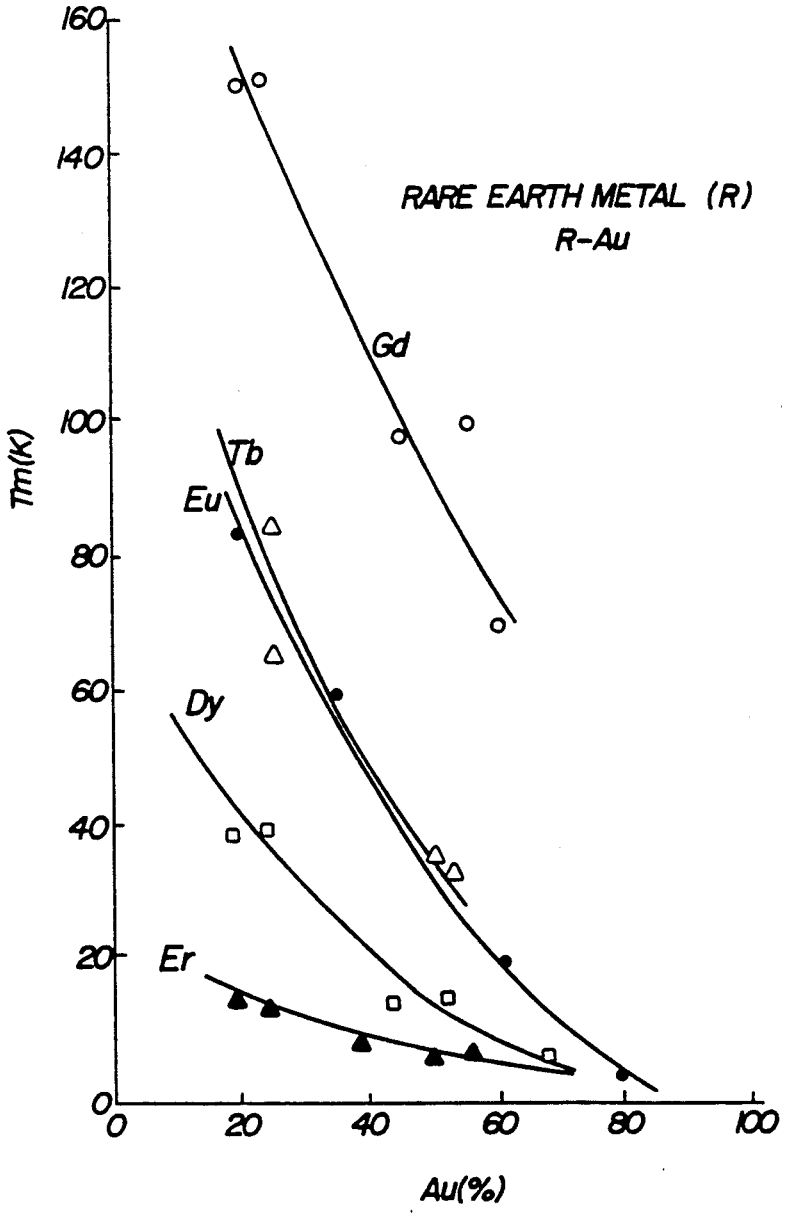
Figure 7:
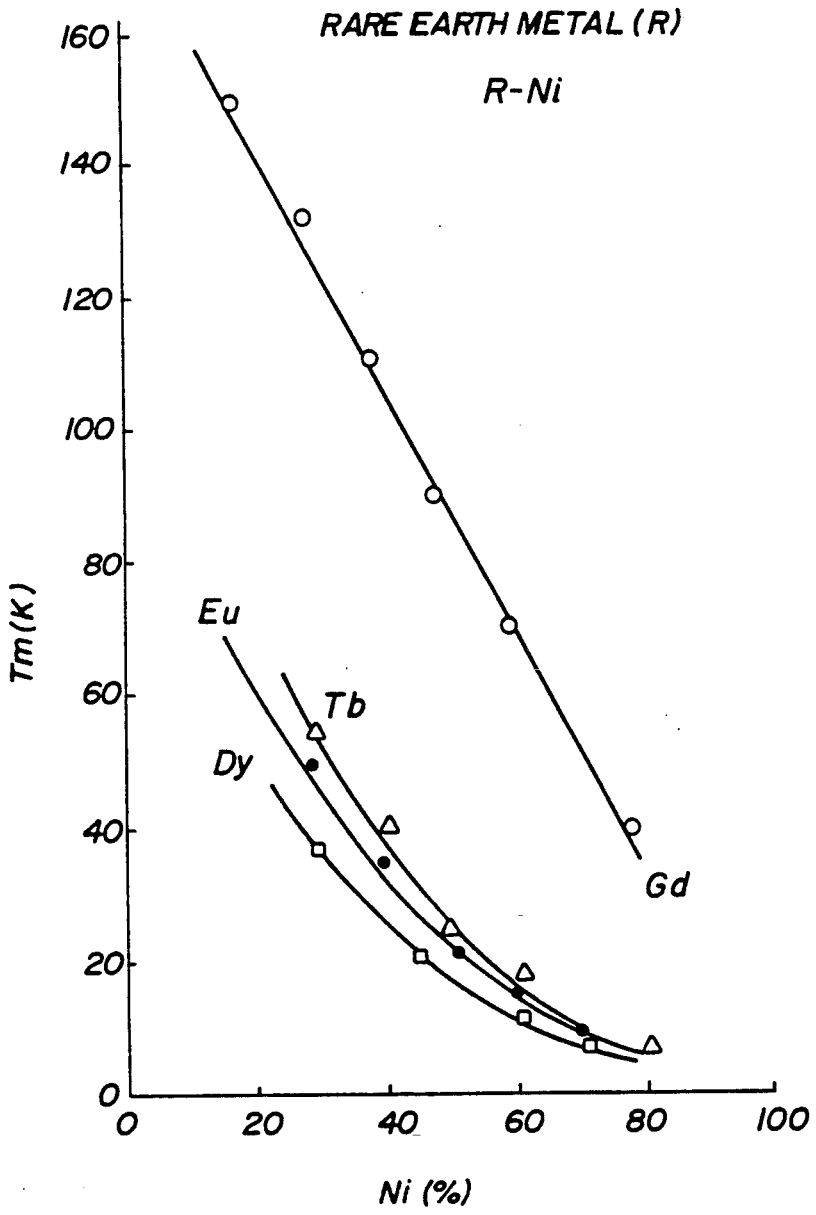
Figure 8:
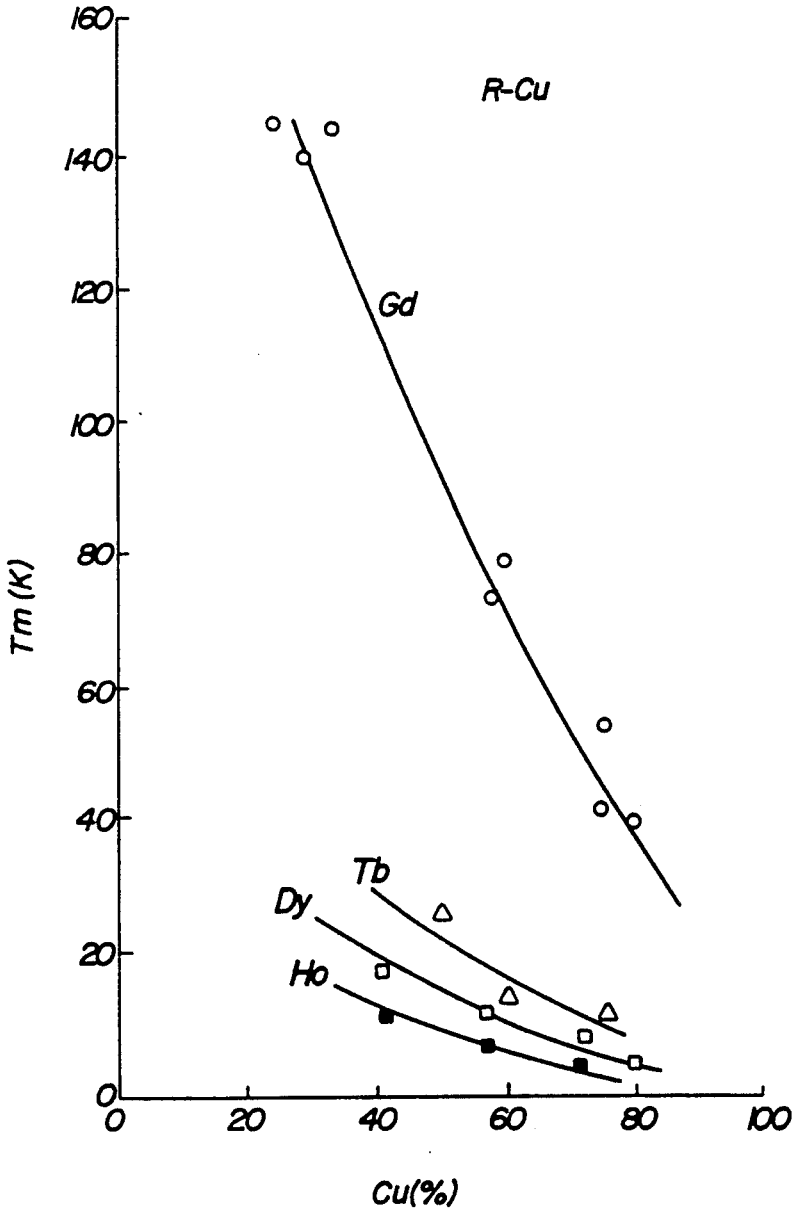
Figure 9:
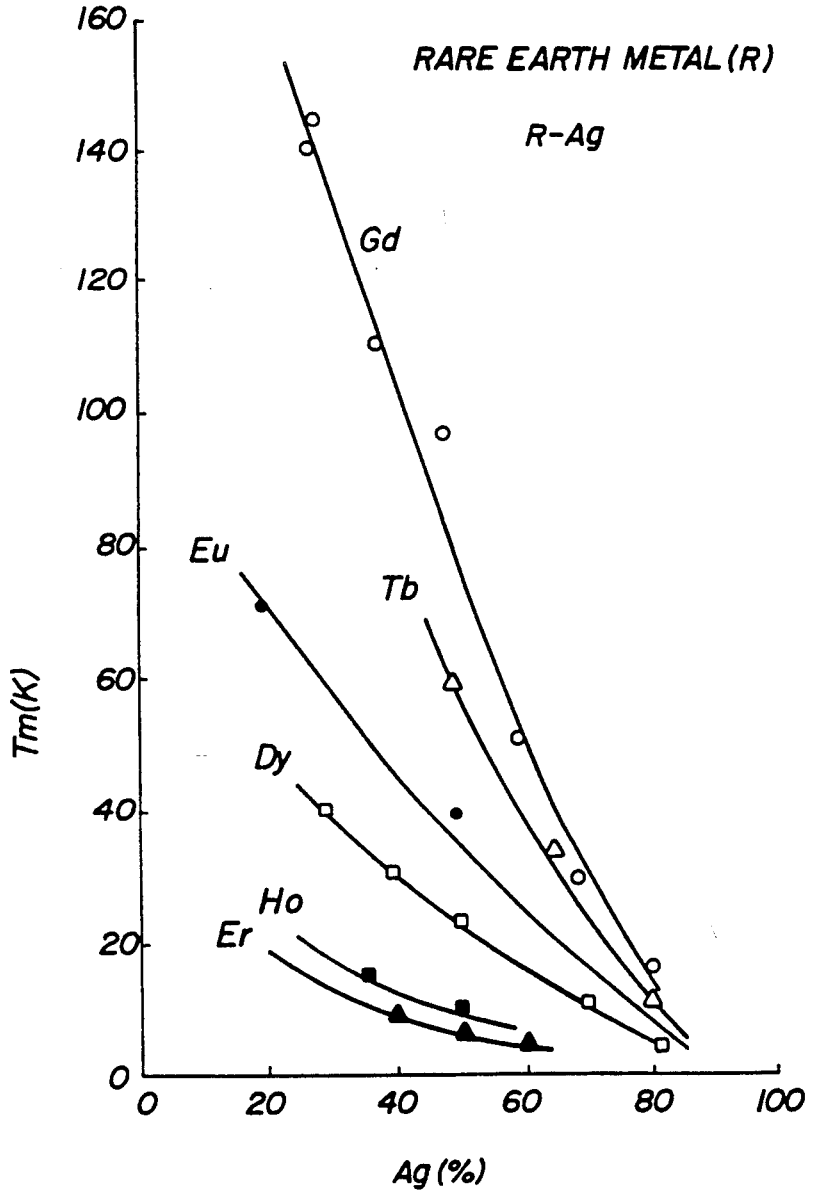
Figure 10:
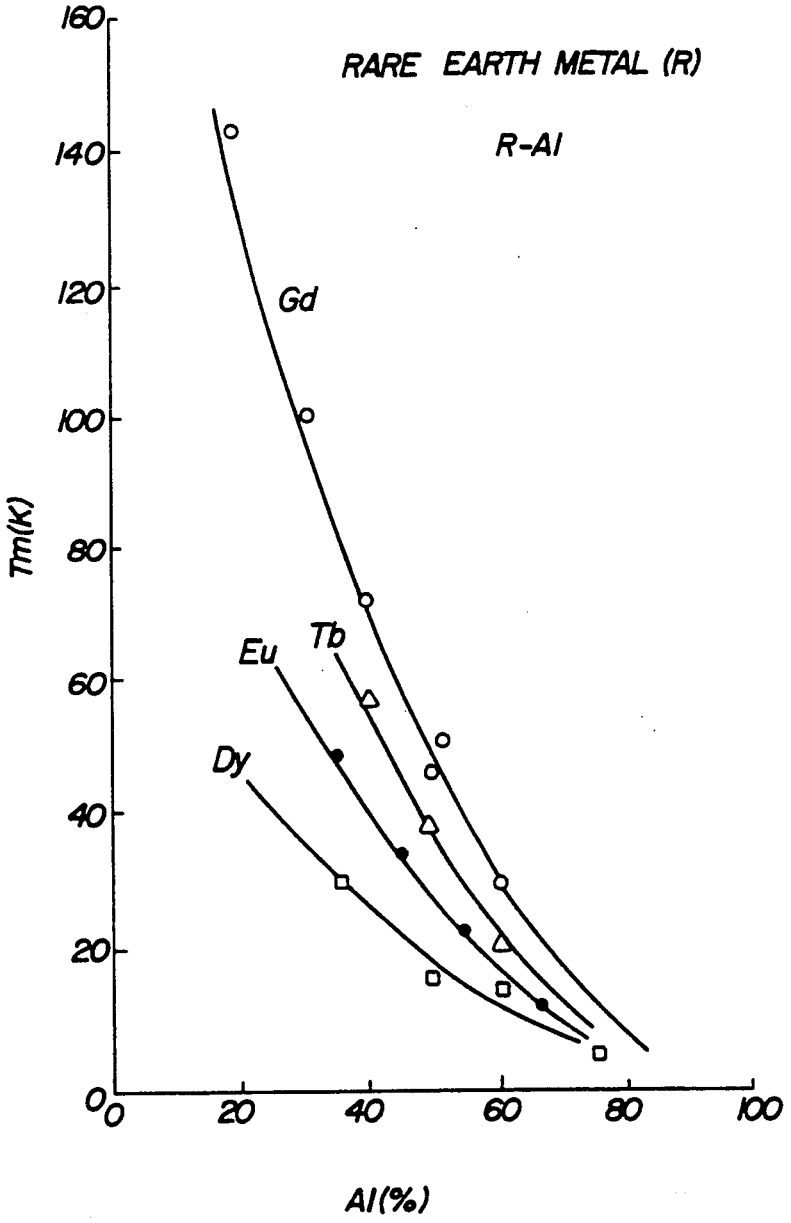
Figure 11:
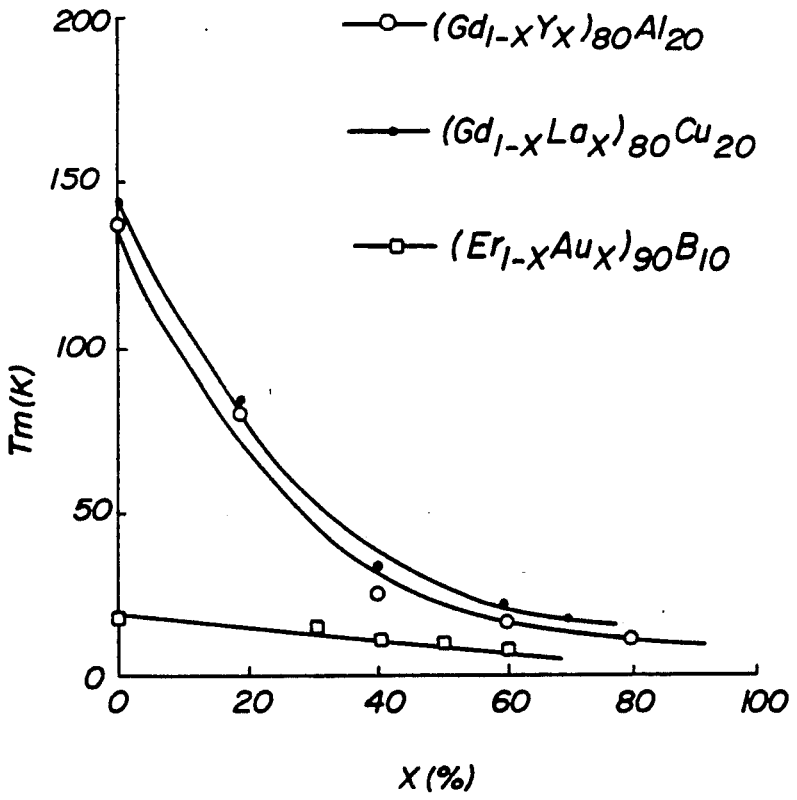
Figure 12:
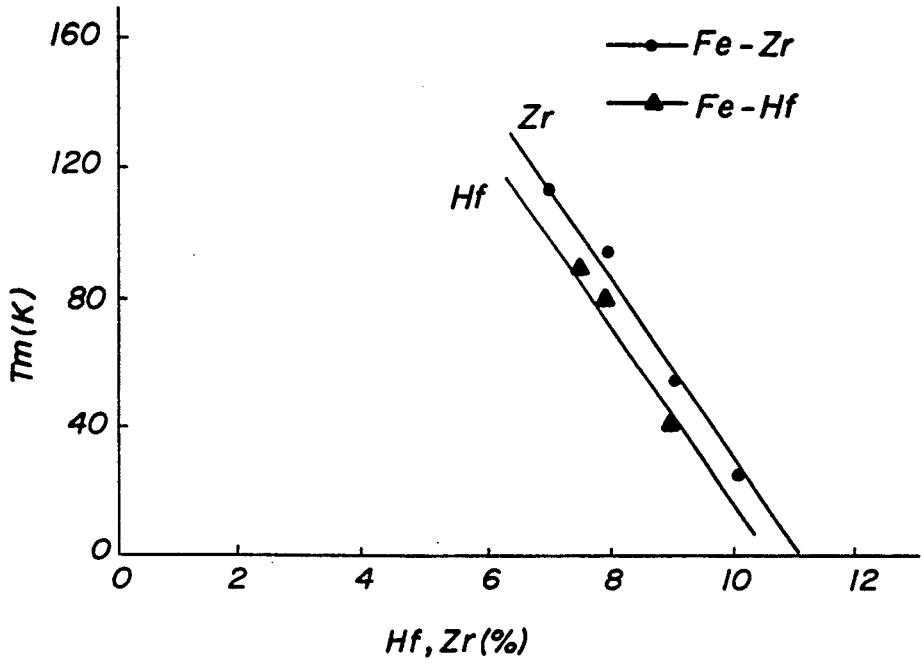
FIGS. 12 through 16 give the composition dependence of the magnetic transition point Tm of various Fe-based amorphous alloys.
Figure 13:
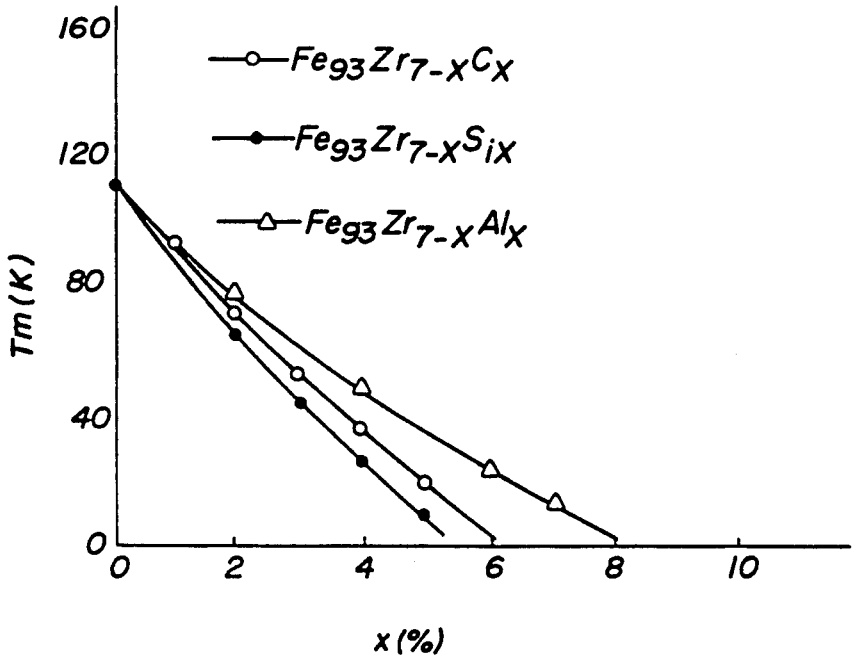
Figure 14:
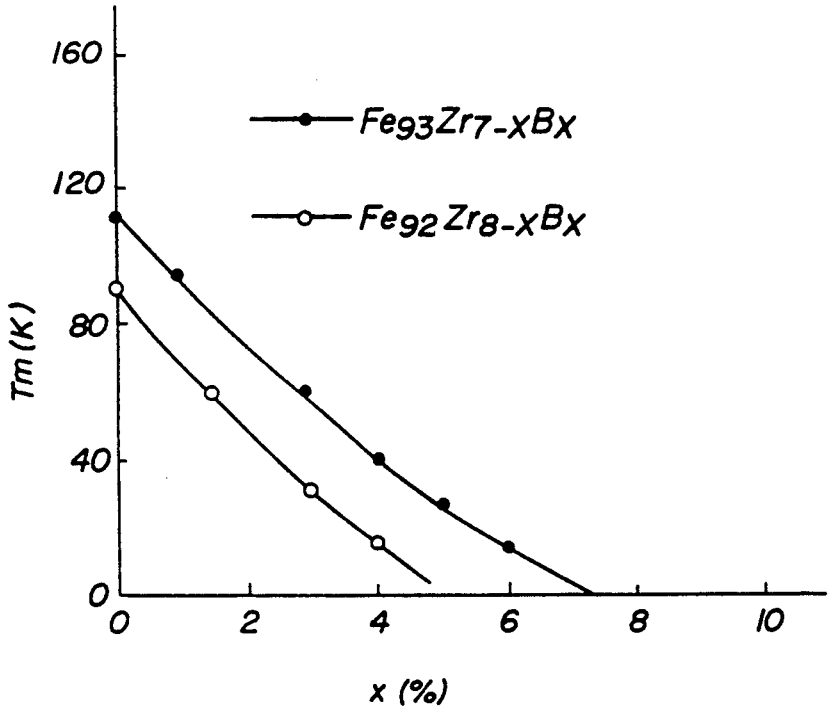
Figure 15:
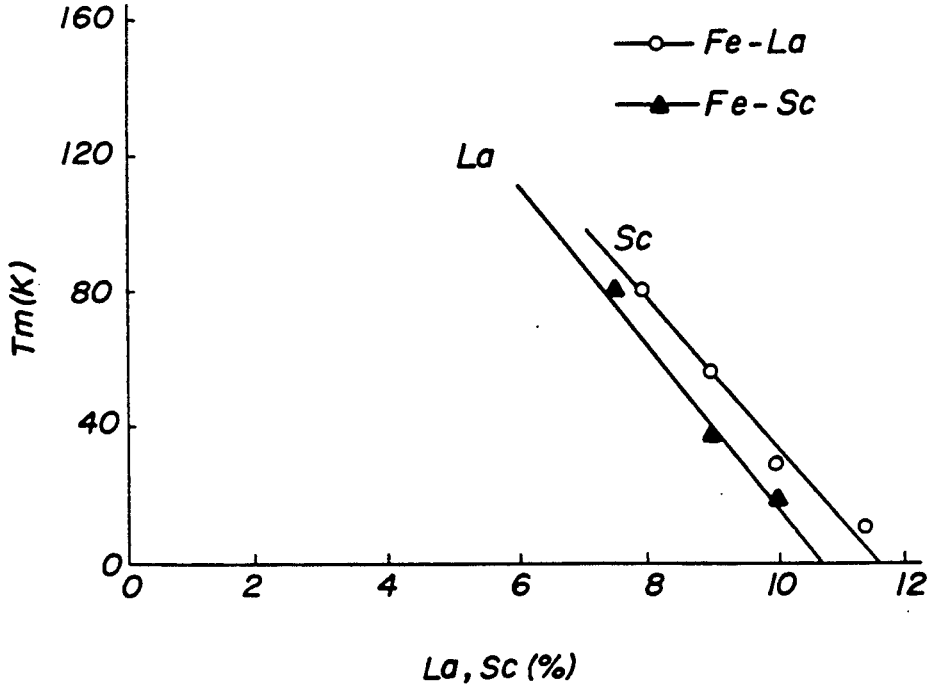
Figure 16:
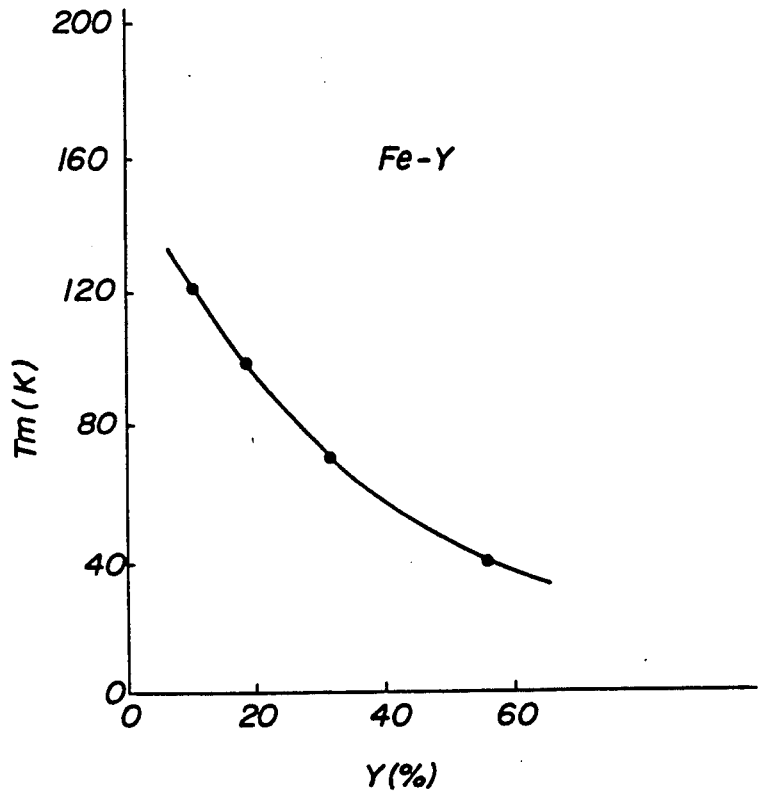

FIG. 4 depicts the relation between the Debye temperature $\theta_D$ and the lattice entropy $S_L$ as a function of the working temperature. It is noted from this figure that the lattice entropy $S_L$ obtained when the substance having the Debye temperature of 350 K. is operated at 200 K. is roughly equal to the lattice entropy $S_L$ obtained when the substance having the Debye temperature of 100 K. is operated at 50 K. From the foregoing observation, it is clear that for magnetically refrigerating substances to obtain high efficiency, it is required to be made of materials possessing as high the Debye temperature as possible. In order to get a high Debye temperature $\theta_D$, this invention causes the amorphous alloys containing rare earth metals to absorb therein hydrogen.

The magnetic moment M is given by the following formula.

$$M = g\mu_B J \quad (5)$$

where g stands for the relation between the spin S and the angular momentum J and $\mu_B$ the Bohr magneton.

The experimental values of the magnetic moment of rare earth metals are as shown in Table 1.

TABLE 1

| Element | Ce | Pr | Nd | Pm | Sm | Eu | Gd |
|---|---|---|---|---|---|---|---|
| M* | 2.51 | 3.56 | 3.3 | — | 1.74 | 7.12 | 7.98 |
| Element | Tb | Dy | Ho | Er | Tm | Yb | |
| M* | 9.77 | 10.67 | 10.8 | 9.8 | 7.6 | 0.21 | |

*Experimental value

It is noted from this table that for the amorphous alloys containing rare earth metals, since the elements ranging between Eu and Tm have a large value of the magnetic moment, the amorphous alloys are desired to contain these elements.

Amorphous alloys containing rare earth metals can be produced by the well-known melt-quenching methods (ribbon method and anvil method) and the sputtering method. Typical combinations of components for the amorphous alloys are as shown below.

[A] Typical combinations of components by the melt-quenching method:

(1) An alloy of Gd and one or more elements selected from the group consisting of C, Al, Ga, Ni, Cu, Ag, Au, Ru, Rh, Pd, Pt, Fe, Co, and Mn.

(2) An alloy of Al and one or more elements selected from the group consisting of Gd, Dy, Tb, Pr, Ho, Er, and Eu.

(3) An alloy of Ni and one or more elements selected from the group consisting of Gd, Dy, Tb, Pr, Ho, Er, and Eu.

(4) An alloy of Au and one or more elements selected from the group consisting of Gd, Dy, Tb, Pr, Ho, Er, and Eu.

(5) An alloy of one of the alloys (2) through (4) and one or more elements selected from the group consisting of La, Y, Sm, Ce, and Nd.

(6) An alloy of one of the alloys (2) through (4) and one or more elements selected from the group consisting of Si, B, and C.

(7) An alloy of Cu and at least one element selected from the group consisting of Dy, Tb, Ho, and Er.

(8) An alloy of Cu and at least one element selected from the group consisting of Dy, Tb, Ho, Er, and Gd.

[B] Typical combinations of components by the sputtering method:

(1) An alloy of Gd and one or more elements selected from the group consisting of Cu, Al, Mg, Ti, V, Cr, Nb, Ge, Si, Au, Fe, Co, Ni, and Mn.

(2) An alloy of Ag and one or more elements selected from the group consisting of Gd, Dy, Tb, Pr, Ho, Er, and Eu.

(3) An alloy of Au and one or more elements selected from the group consisting of Gd, Dy, Tb, Pr, Ho, Er, and Eu.

(4) An alloy of Cu and one or more elements selected from the group consisting of Gd, Dy, Tb, Pr, Ho, Er, and Eu.

(5) An alloy of Ni and one or more elements selected from the group consisting of Gd, Dy, Tb, Pr, Ho, Er, and Eu.

(6) An alloy of one element selected from the group consisting of Tb, Ho, Dy, and Er and one element selected from the group consisting of Ge, Ga, In, and Sn.

Also, Fe-based amorphous alloys can be produced by the well-known melt-quenching methods (ribbon method and anvil method) and the sputtering method as well as by any other methods available at all. In this case, as the additional element for formation of the amorphous phase, any of the known additional elements such as C, B, Si, Al, Hf, Zr, Y, Sc, and La can be used. Optionally, two or more such additional elements may be contained in combination. The content of the additional element in the alloy is desired to be so small as to fall below 12%. Exceptionally, Y may be contained in a relatively large value up to about 60%. Typical combinations of components including such additional, elements are shown below.

(1) An alloy of Fe and one or more elements selected from the group consisting of Zr, Hf, Sc, La, and Y.

(2) An alloy of Fe, one or more elements selected from the group consisting of Zr, Hf, Sc, La, and Y, and one or more elements selected from the group consisting of C, B, Si, and Al.

Figure 22:
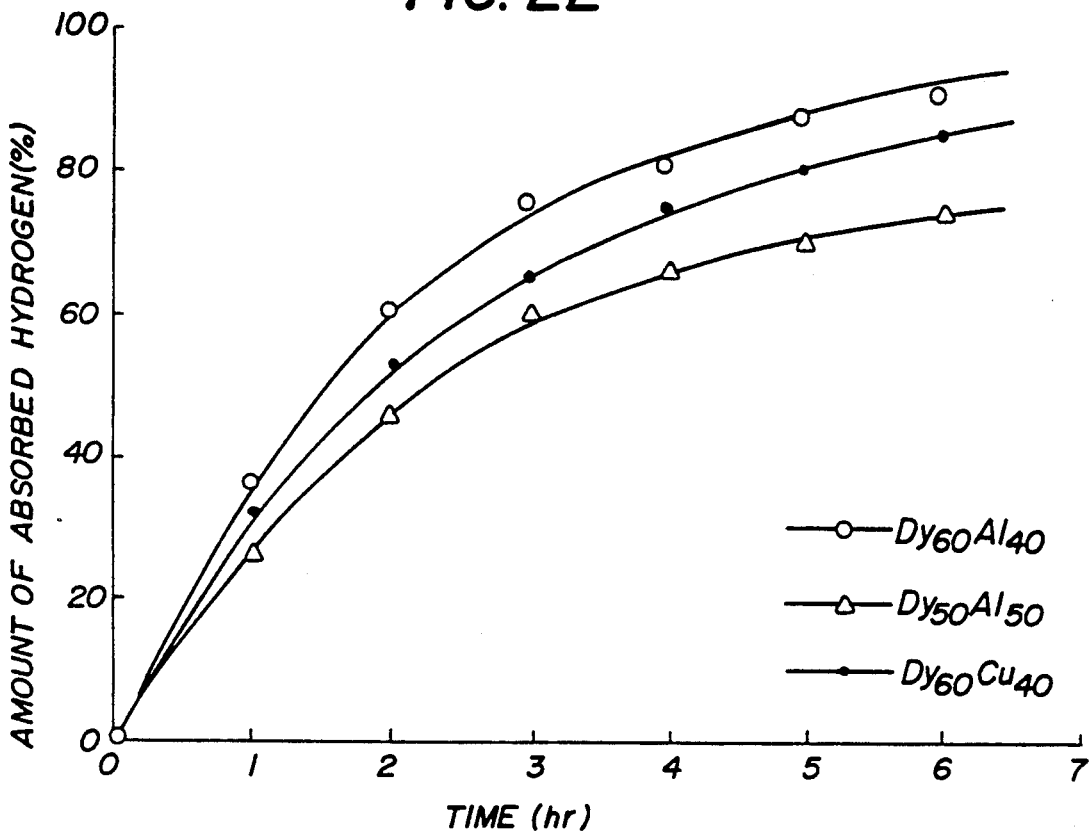
FIG. 22 shows the time dependence of the amount of absorbed hydrogen.
Figure 23:
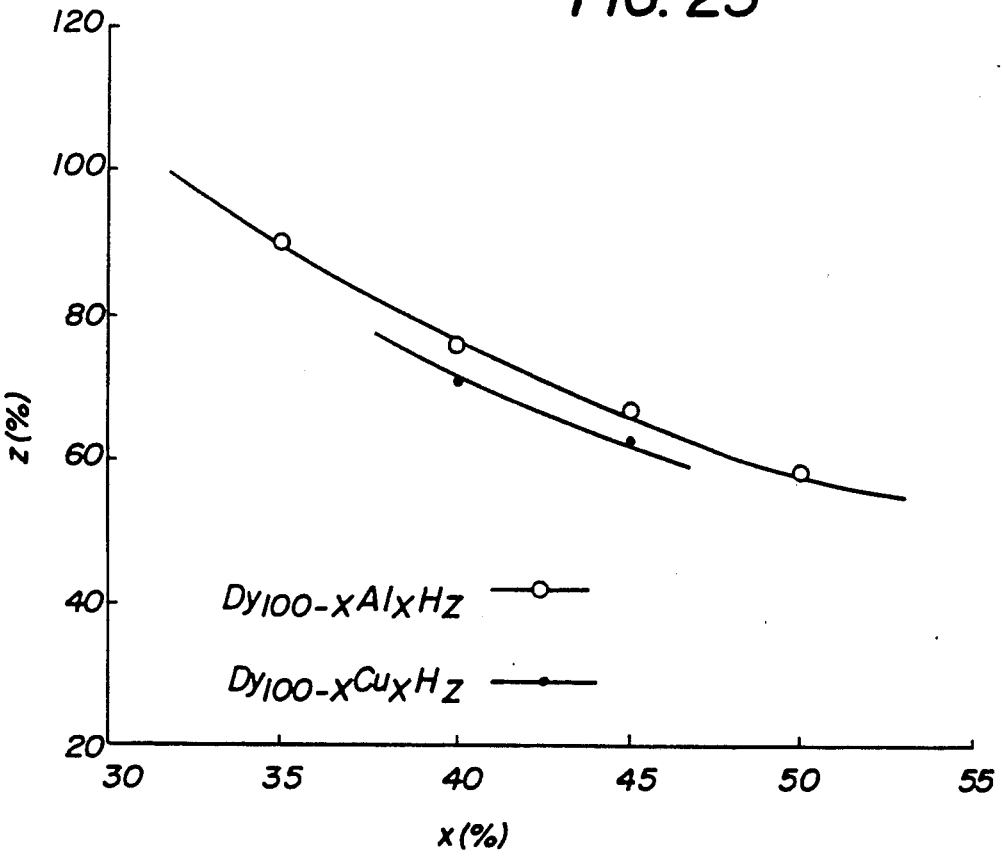
FIG. 23 shows the relation between the amount of absorbed hydrogen and the composition.

The magnetic transition point, Tm, of the amorphous alloys containing rare earth metals and Fe-based amorphous alloys depends upon the alloy composition. Typical data showing this dependence are given in FIGS. 5 through 16. FIG. 5 through FIG. 11 represent data of the amorphous alloys containing rare earth metals and FIG. 12 through FIG. 16 represent data of Fe-based amorphous alloys. The contents indicated therein are given by the atomic %. The absorption of hydrogen into the amorphous alloys is carried out under application of pressure at temperatures tens of centigrade degrees lower than the temperatures at which the hydrides in the crystalline phases are precipitated. In this case, the amounts of absorbed hydrogen vary with the duration of pressure application and depend on the composition of rare earth metals. FIG. 22 shows time dependence of the amounts of absorbed hydrogen when Dy-Al and Dy-Cu amorphous alloys (contents expressed in the atomic %) are absorbed at 0.5 MPa of the hydrogen pressure and 400 K. It is noted that the alloys absorb hydrogen abruptly in the initial stage and that the ratios of increase of the amounts of absorbed hydrogen are slowed down with elapse of time. It is evident from the results of the Dy-al amorphous alloys that the amount of absorbed hydrogen increases in proportion as the content of the rare earth metal is increases. This relation is evinced by the fact that in FIG. 23 showing data on two different alloys, the amount of absorbed hydrogen is larger when the content of the same rare earth metal, Dy, is larger.

Figure 24:
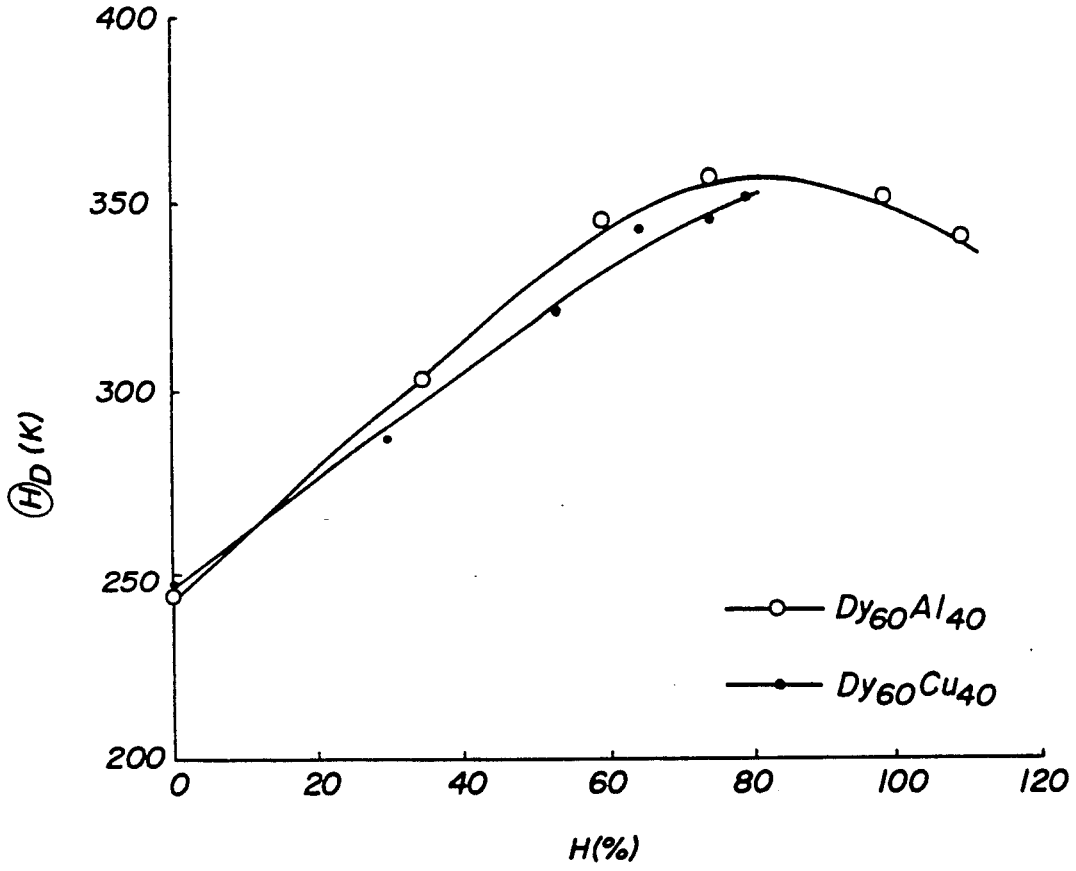
FIG. 24 shows the relation between the amount of absorbed hydrogen and the Debye temperature.

In the case of the amorphous alloys containing rare earth metals absorbed hydrogen therein, their Debye temperatures depend on the alloy composition. Typical data showing this dependence are given FIG. 24. The data cover the absorption of hydrogen (% indicating the atomic %) in the amorphous alloys of $Dy_{60}Al_{40}$ and $Dy_{60}Cu_{40}$. The Debye temperatures $\theta_D$ of the alloy samples in their as-prepared state are both about 250 K. As the absorption increases above about 60%, their Debye temperatures both rise to about 359 K., the increment of about 40%. It should be noted from the results shown in FIG. 24 and the data of FIG. 4 that when the Dy-Al amorphous alloy is operated at 50 K., the lattice entropy $S_L$ of the alloy absorbed hydrogen is less than one half of the lattice entropy $S_L$ of the alloy absorbed no hydrogen. These results are similarly obtained in the case of other amorphous alloys containing rare earth metals already cited above.

As explained in the foregoing examples, this invention, by producing ternary and quaternary alloys of various elements, alloys the magnetic transition points Tm to be distributed substantially throughout the whole range of temperatures of magnetically working abilities. A number of amorphous alloys with various compositions may be collectively incorporated in the same unit. In this case, the magnetic transition points Tm can be continuously varied by changing continuously the compositions of many alloys. Consequently, the peaks of the temperature dependence curve of the value of $\Delta Sm$ as shown in FIG. 1 (A) can be continuously levelled.

The magnetically working substances of the present invention, in one aspect, are characterized by adiabatically demagnetizing the amorphous alloys in a weak magnetic field or a strong magnetic field and utilizing the spin glass property thereof.

Figure 2:
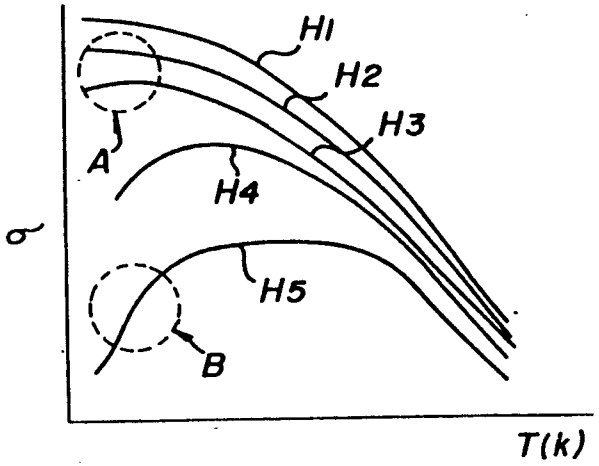

Now, this characteristic of this invention will be described below with reference to the temperature dependence of magnetization illustrated in FIG. 2. When the amorphous alloy is exposed to weak external magnetic field H such as, for example, $H_1=1000$ Oe, $H_2=500$ Oe, $H_3=150$ Oe, or $H_4=100$ Oe, and then adiabatically demagnetized, the spins which are almost parallel as those in a ferromagnetic substance (A) in the neighborhood of a circle A indicated in the figure. On the other hand, in the neighborhood of a circle B in the figure, the spins are oriented in the random directions as those in a paramagnetic substance in an extremely weak external magnetic field such as $H_5=30$ Oe or in a demagnetized state (B). Thus, the spin glass property is manifested. Of course, this situation remains the same when the applied external magnetic field is strong.

When this spin glass property is utilized, the magnetically working amorphous substances of this invention has no particular use for such a strong magnetic field ranging from several teslas to ten teslas, the level indispensable to the conventional oxide. Thus, even in an extremely weak magnetic field one-thousandth of the aforementioned level, the spins can be easily aligned as though the spins in a ferromagnetic substance.

EXAMPLE 1

Figure 17:
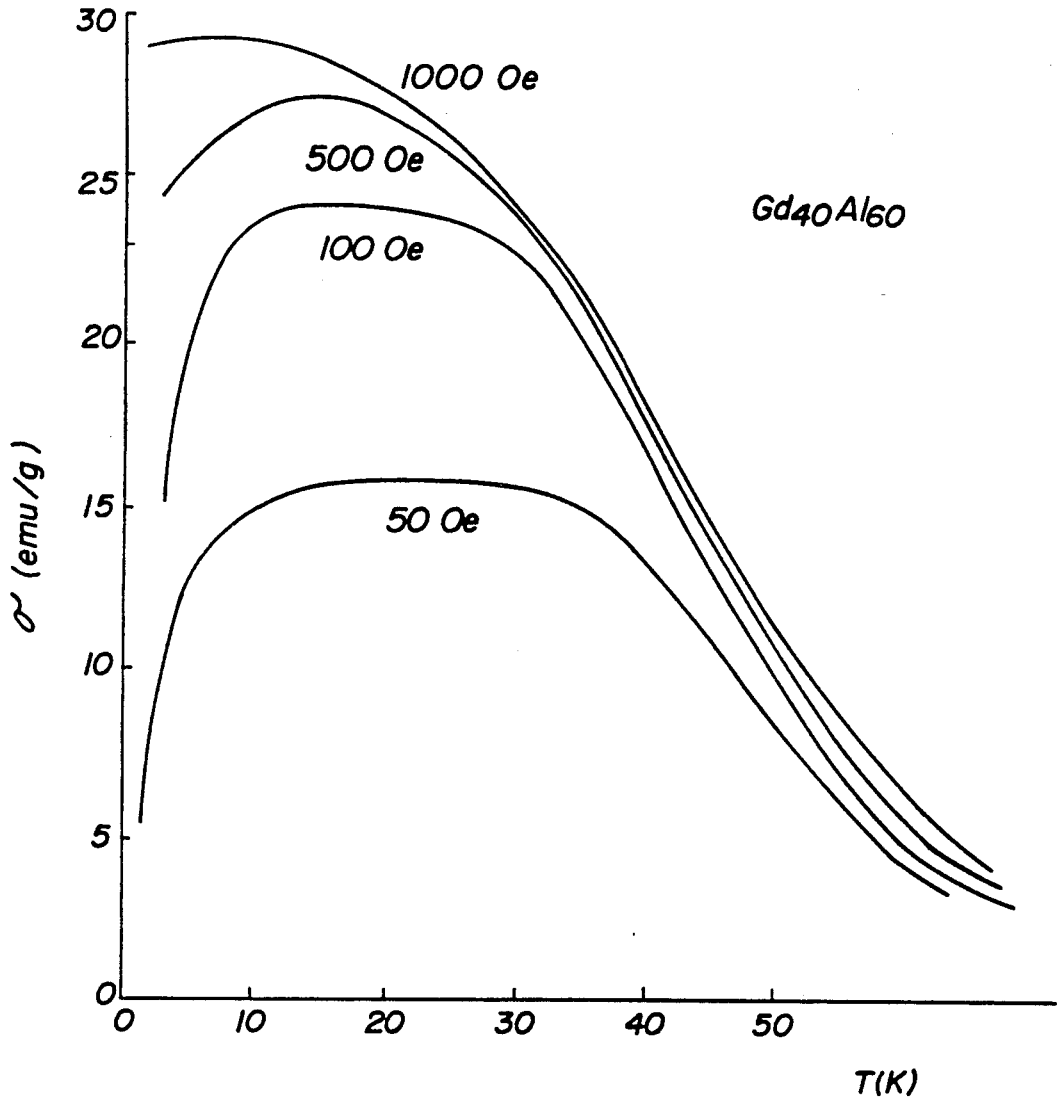
FIGS. 17 through 19 give the temperature dependence of the magnetization of various amorphous alloys containing rare earth metals at different external magnetic fields.

Ribbons of amorphous alloy, $Gd_{40}Al_{60}$, were prepared by the melt-quenching method, exposed to the external magnetic fields 50, 100, 500, and 1,000 Oe, and tested for the temperature dependence of magnetization. The results are shown in FIG. 17. When the application of a magnetic field of 1,000 Oe and the demagnetization were repeated a total of 50 cycles, the alloy ribbons produced effective magnetic cooling between the points of 30 K. and 10 K.

Figure 18:
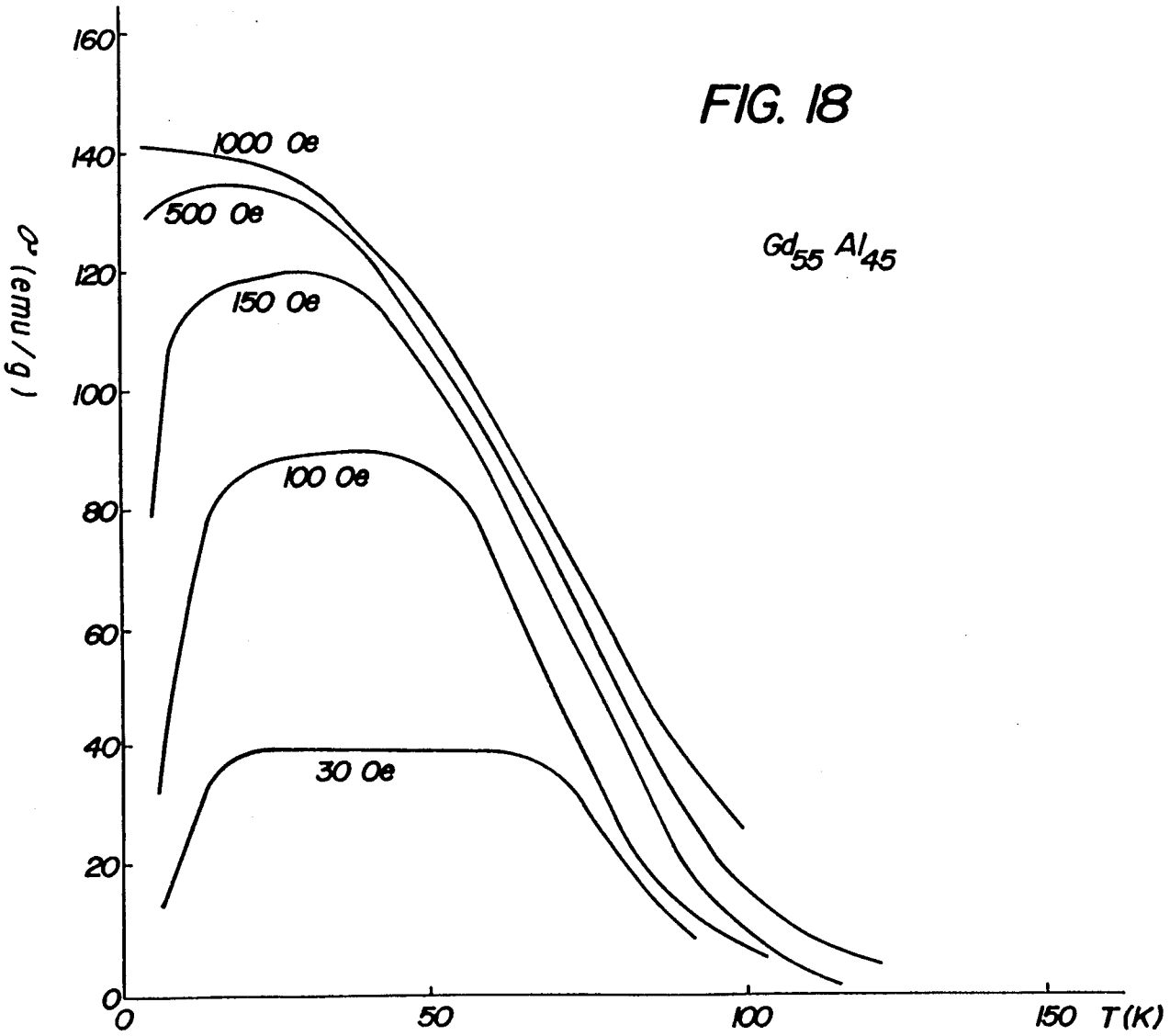
Figure 19:
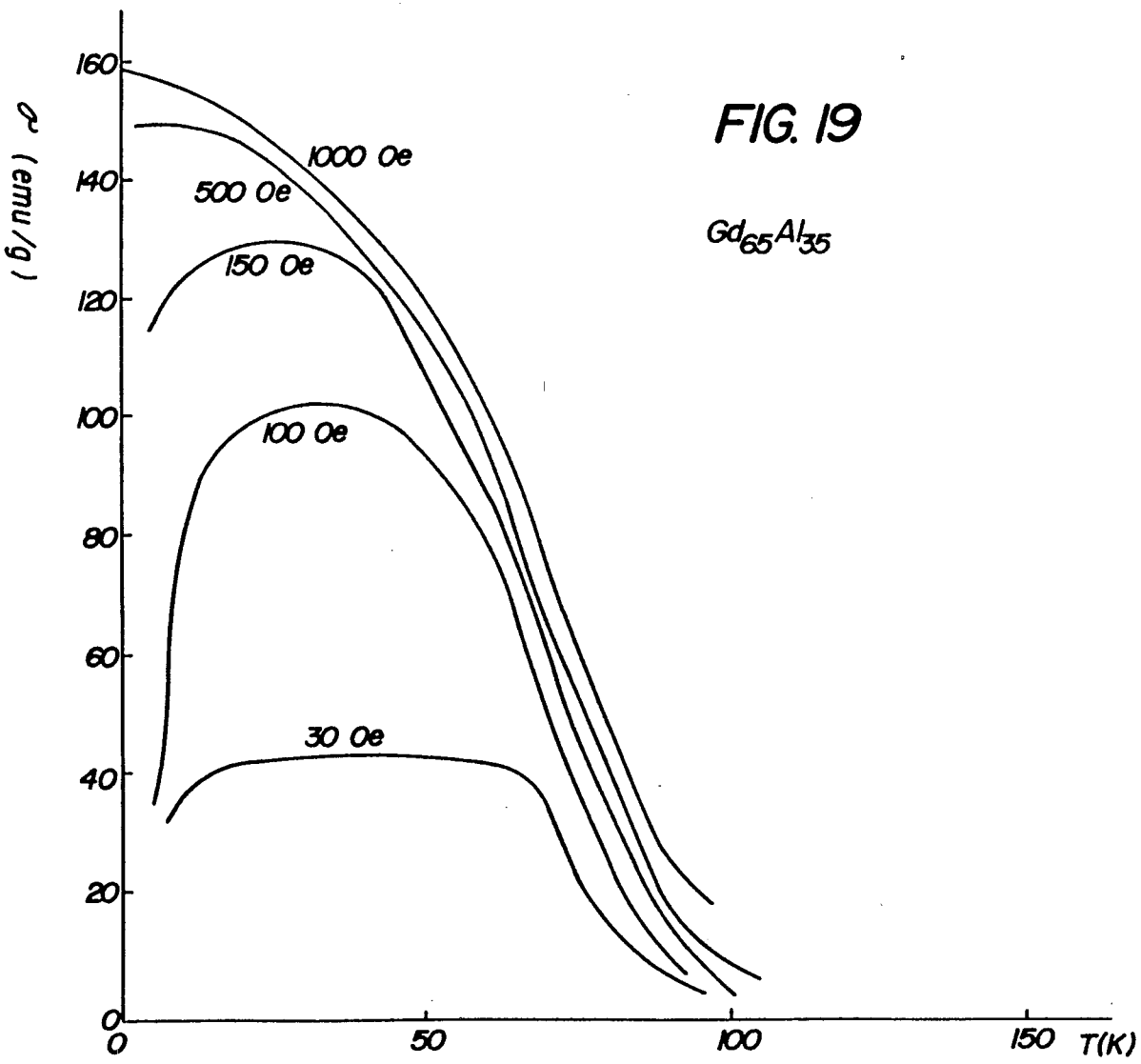

Similarly, ribbons of amorphous alloys, $Gd_{55}Al_{45}$ and $Gd_{65}Al_{35}$, were prepared and tested for temperature dependence of magnetization under application of the magnetic fields 30, 100, 150, 500, and 1,000 Oe. The results are shown in FIG. 18 and FIG. 19.

Since the magnetic transition point rises with the increasing concentration of Gd, these amorphous alloys enabled magnetic refrigeration to be started at still higher temperatures than the amorphous $Gd_{40}Al_{60}$ alloy and the values of magnetization were larger than the amorphous $Gd_{40}Al_{60}$ alloy. These alloys, therefore, have a higher efficiency of refrigeration.

EXAMPLE 2

Figure 20:
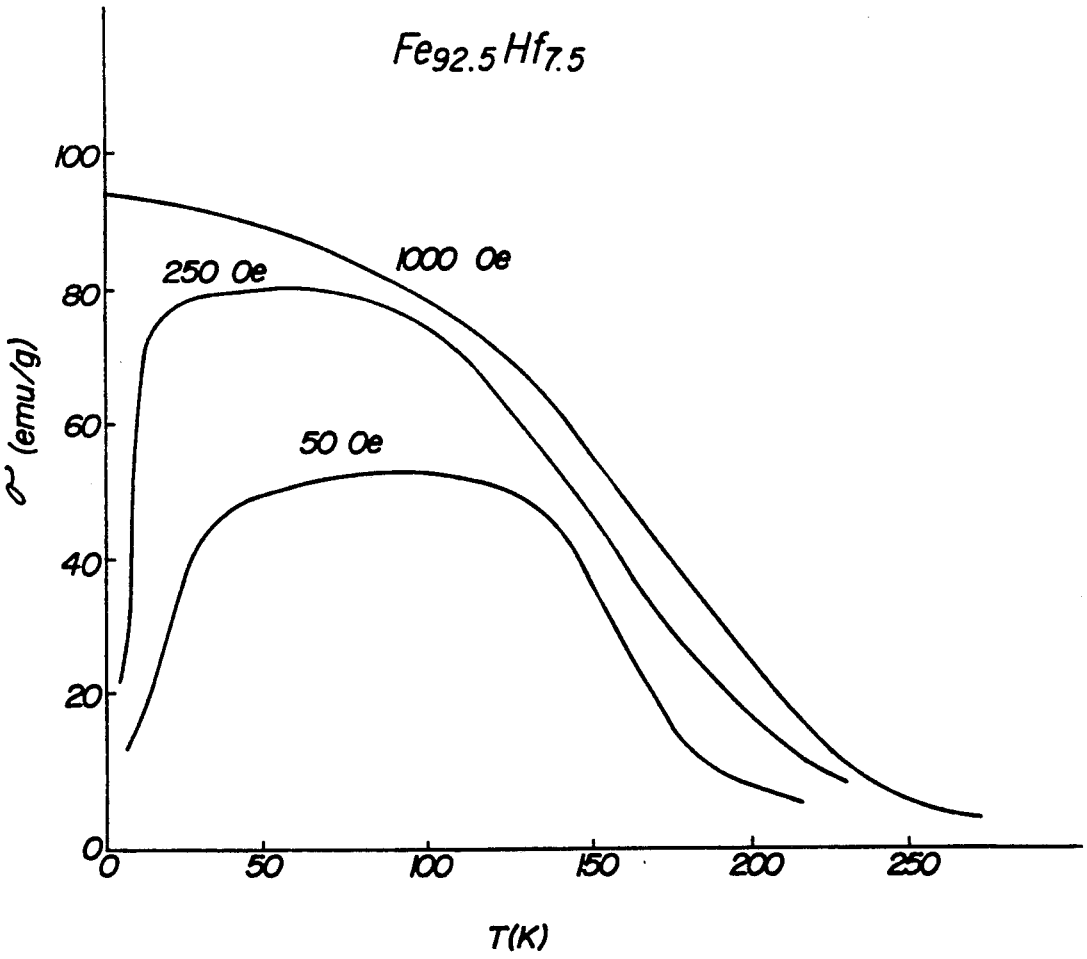
FIG. 20 and FIG. 21 show the temperature dependence of the magnetization of various Fe-based amorphous alloys of different external magnetic fields.

Ribbons of amorphous alloy, $Fe_{92.5}Hf_{7.5}$, were prepared by the melt-quenching method, exposed to the external magnetic fields of 50, 250, and 1,000 Oe, and tested for temperature dependence of magnetization. The results are shown in FIG. 20. When the application of a magnetic field of 1,000 Oe and the demagnetization were repeated a total of 80 cycles, the alloy ribbons produced magnetic cooling between the points of 30 K. and 10 K.

Figure 21:
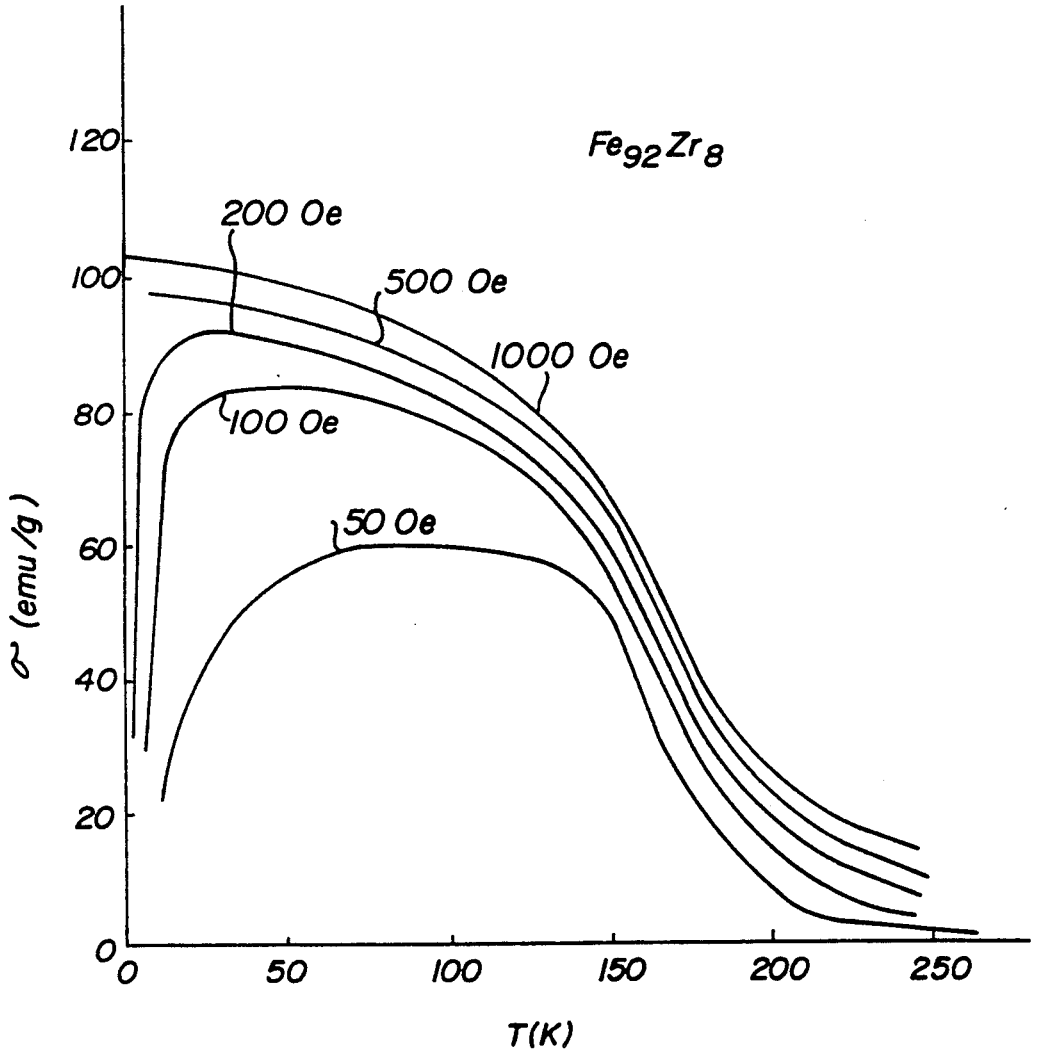

Similarly, ribbons of amorphous alloy, $Fe_{92}Zr_8$, were prepared and tested for temperature dependence of magnetization under the external magnetic fields of 50, 100, 200, 500, and 1,000 Oe. The results are shown in FIG. 21.

EXAMPLE 3

Figure 25:
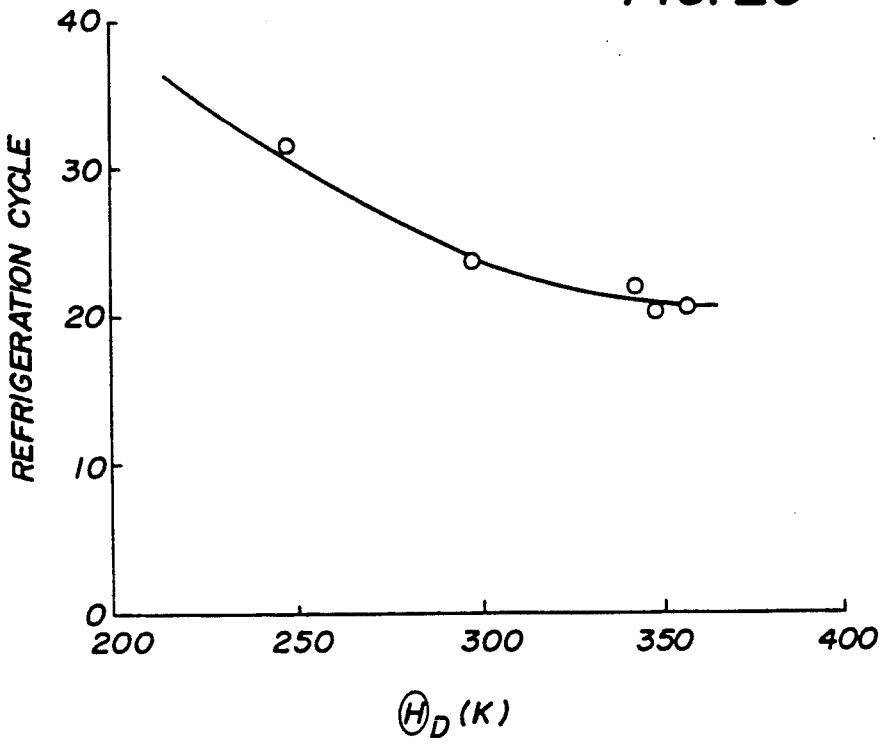
FIG. 25 shows the relation between the refrigeration cycle and the Debye temperature.

Ribbons of amorphous alloy, $Dy_{60}Al_{40}$, were prepared by the melt-quenching method. Some of these alloy ribbons were absorbed hydrogen at 400 K. and 0.5 MPa of hydrogen. The alloy ribbons absorbed hydrogen therein and the alloy ribbons absorbed no hydrogen therein were tested for magnetic cooling efficiency. The results are compared in FIG. 25. In this test, a magnetic field of 1,000 Oe was applied. In the figure, the freezing cycle permitting magnetic cooling between the points of 30 K. and 10 K. is indicated against the scale of the ordinate and the value of the Debye temperature $\theta_D$ the scale of the abscissa.

It is noted from the figure that the number of cycle decreases with the increasing the Debye temperature. In other words, the cooling efficiency increases with rising the Debye temperature.

It is clear from the foregoing detailed description that the magnetically working substances of this invention is formed of the amorphous alloys containing rare earth metals with a large magnetic moment and having the spin glass property or the same amorphous alloys absorbed hydrogen therein or Fe-based amorphous alloys and the magnetically working substances are enabled to produce magnetically working abilities by demagnetization adiabatically in a weak magnetic field. The magnetically working substances of the present invention, therefore, have various advantages: (1) The amorphous alloys containing rare earth metals and the the same amorphous alloys absorbed hydrogen therein can have their compositions freely selected with ease and the Fe-based amorphous alloys can have their composition freely selected on their Fe component side with ease and, therefore, the magnetic transition points can be freely set. When a magnetically refrigerating substance is composed by such various amorphous alloys incorporated collectively in the same unit, it obtains extremely high efficiency because the magnetic transition points can be continuously varied by changing continuously the composition of each amorphous alloy. (2) The magnetic elements and the additional elements for formation of the amorphous phase can be selected each from various kinds of elements. (3) Since the magnetically working substances are metallic in nature, they have a high thermal conductivity. In the case of magnetic refrigeration, for example, the time rate, of refrigeration cycle can be shortened and the refrigeration effect can be obtained quickly. (4) Since the magnetically working substances exhibit the spin glass behavior, it can be saturated in an extremely weak magnetic field and necessitates no particular application of a strong magnetic field. (5) The amorphous alloys containing rare earth metals and the Fe-based amorphous alloys are excellent in mechanical properties, easy to handle, stable to resist impacts and cyclic motions. Particularly the Fe-based amorphous alloys are inexpensive and stabler to resist oxidation than the rare earth metal-based amorphous alloys. (6) The amorphous alloys absorbed hydrogen produce magnetically working abilities with a remarkably good efficiency.

INDUSTRIAL UTILITY OF THE INVENTION

The magnetically working substances of the present invention permit the magnetic refrigeration or cooling in the temperatures ranging from relatively high temperatures exceeding room temperature to low temperatures by the use of an ordinary electromagnet without use of a superconducting magnet. Thus, it finds extensive utility in applications to very large plants such as MHD power generation, nuclear fusion, and energy storage and to various devices such as linear motors, electronic computers and their peripheral appliances.

I claim:

1. A method of producing refrigeration and cooling by adiabatical demagnetization of an amorphous substance, which comprises:

preparing an amorphous substance comprising an amorphous alloy selected from the group consisting of an amorphous alloy containing at least one rare earth metal and an amorphous alloy containing at least Fe; and applying to the amorphous substance an external magnetic field in an amount sufficient to adiabatically demagnetize said amorphous substance, whereby producing magnetic refrigeration and cooling.

2. A method according to claim 1, wherein the strength of the external magnetic field is less than 1000 Oe.

3. A method according to claim 1, wherein the strength of the external magnetic field is more than 2 teslas.

4. A method according to claim 1, wherein the amorphous alloy containing at least one rare earth metal consising of from 20 to 90 atomic % of at least one rare earth metal and the remainder is selected from the group consisting of Al, Ni, Co, V, Au, Ag, Cu, Ge, Ru, B and Si.

5. A method as claimed in claim 4, wherein said rare earth metal comprises 20 to 80 atomic per cent of said alloy.

6. A method according to claim 4, wherein said rare earth metal is at least one selected from the group of Eu, Gd, Tb, Dy, Ho, Er and Tm.

7. A method according to claim 4, wherein said amorphous alloy contains a member selected from the group consisting of Y, La and Au and a member selected from the group consisting of Al, Cu and B.

8. A method according to claim 7, wherein said amorphous alloy contains a member selected from the group consisting of Al and Cu, wherein the Debye temperature of said alloy has been increased by absorption of hydrogen.

9. A method according to claim 1, wherein the amorphous alloy containing at least Fe comprises a member selected from the group consisting of Zr and Hf in an amount from about 7 to about 10 atomic % based on the alloy and the remainder of the alloy is Fe.

10. A method according to claim 1, wherein the amorphous alloy containing at least Fe comprises a member selected from the group consisting of La and Sc in an amount from about 7 to about 11 atomic % based on the alloy and the remainder of the alloy is Fe.

11. A method according to claim 1, wherein the amorphous alloy containing at least Fe comprises Zr in an amount from about 4 to about 12 atomic % based on the alloy, one member selected from the group consisting of C, Si, Al and B in an amount from about 1 to about 7 atomic % based on the alloy, with the remainder of the alloy being Fe.

12. A method according to claim 1, wherein the amorphous alloy containing at least Fe comprises Y in an amount from 6 to 60 atomic % based on the alloy and the remainder of the alloy is Fe.

13. A method as claimed in claim 12, wherein said Y is present in an amount of from 12 to 60 atomic percent of said alloy.

* * * * *